US006786577B2

(12) United States Patent
Tamahashi et al.

(10) Patent No.: US 6,786,577 B2
(45) Date of Patent: Sep. 7, 2004

(54) INKJET PRINT HEAD AND METHOD FOR MAKING THE SAME

(75) Inventors: Kunihiro Tamahashi, Hitachinaka (JP); Yoshiaki Tachibana, Hitachinaka (JP); Jun Nagata, Hitachinaka (JP)

(73) Assignee: Hitachi Printing Solutions, Ltd., Hitachinaka (JP)

( * ) Notice: Subject to any disclaimer, the term of this patent is extended or adjusted under 35 U.S.C. 154(b) by 93 days.

(21) Appl. No.: 10/270,123

(22) Filed: Oct. 15, 2002

(65) Prior Publication Data

US 2003/0076386 A1 Apr. 24, 2003

(30) Foreign Application Priority Data

Oct. 19, 2001 (JP) ..... 2001-321582
Aug. 26, 2002 (JP) ..... 2002-244722

(51) Int. Cl.[7] ..... B41J 2/045

(52) U.S. Cl. ..... 347/71

(58) Field of Search ..... 347/68–72, 20, 347/47; 156/60; 29/890.1

(56) References Cited

U.S. PATENT DOCUMENTS 6,074,510 A * 6/2000 Tachibana et al. ..... 156/245
6,079,810 A * 6/2000 Davis ..... 347/47
6,361,146 B1 * 3/2002 Saldanha Singh et al. .... 347/50

* cited by examiner

*Primary Examiner*—Judy Nguyen
(74) *Attorney, Agent, or Firm*—McGinn & Gibb, PLLC

(57) ABSTRACT

An inkjet print head with an ink channel unit (and a method therefore) includes a plurality of plates adhered together to form an inkjet head. An adhesive sheet for adhering together the plurality of plates, includes an adhesive element dispersed in a polymer matrix having an average molecular weight of 50,000 or more. The polymer matrix includes a resin.

12 Claims, 4 Drawing Sheets

INKJET PRINT HEAD AND METHOD FOR MAKING THE SAME

BACKGROUND OF THE INVENTION

1. Field of the Invention

The present invention relates to an inkjet print head and a method for making the same. More specifically, the present invention relates to an inkjet print head that uses an adhesive sheet to contribute to improved yield in inkjet print head production.

2. Description of the Related Art

In the inkjet print head field, the nozzle pitch of an inkjet print head has been decreasing year by year, leading to a demand for high-precision processing technology.

In the assembly of ink channel forming plates in the ink channel unit of the head, a well-known method uses adhesives. In many cases, the adhesive is an epoxy adhesive. However, if an epoxy resin with a low molecular weight is used as the adhesive on an entire surface, the adhesive may spread into ink channels when a pressure is applied for adhesion in the assemble process.

Thus, to limit the spreading out of the adhesive, a thickness of the adhesive agent must be controlled.

Japanese Laid-Open Patent Publication Number 11-10864 discloses a method in which a filler is dispersed in the adhesive agent to serve as a spacer. As such, the filler diameter must be small in order to provide a uniform coating. However, smaller diameters reduce the effectiveness of fillers as spacers. Thus, establishing optimal conditions in the production of an inkjet print head using adhesives is difficult.

SUMMARY OF THE INVENTION

In view of the foregoing and other problems, drawbacks, and disadvantages of the conventional methods and structures, an object of the present invention is to provide an easily reproducible method for heating and pressurizing multiple inkjet channel forming plates during a process of forming ink channel units in inkjet print heads, and to provide an inkjet print head with uniform ink jetting characteristics.

Another object of the present invention is to provide an adhesive agent that eliminates or reproducibly controls the spreading out of an adhesive agent to an ink channel when adhesion is performed by applying heat and pressure.

In a first aspect of the invention, an inkjet print head with an ink channel unit is provided. The inkjet head includes a plurality of plates and an adhesive sheet for adhering together the plurality of plates. The adhesive sheet includes an adhesive element dispersed in a polymer matrix. The polymer matrix includes a resin.

According to another aspect of the invention, a cross-linking agent is added to the polymer matrix.

According to another aspect of the invention, the polymer matrix is formed from an epoxy resin with an average molecular weight of at least about 50000 amu.

According to another aspect of the invention, a curing temperature of an adhesive element in the adhesive sheet is lower than a curing temperature of the polymer matrix. The adhesive agent is prepared using an epoxy resin having a low average molecular weight of no more than about 10000 amu.

According to another aspect of the invention, a ratio of the adhesive element to the polymer matrix is within a range of about 1% to about 60% by solids content weight.

According to another aspect of the invention, the adhesive sheet has a thickness of about 1 micron to about 10 microns.

Additionally, in accordance with another aspect of the invention, a method for making an inkjet print head equipped with an ink channel unit is provided. The method includes forming an opening matching a channel pattern of a first plate in an adhesive sheet with a carrier sheet, performing a preliminary adhesion by setting the adhesive sheet to the first plate in alignment with the channel pattern, peeling away the carrier sheet on the adhesive sheet, and laminating a second plate on the adhesive sheet and applying heat and/or pressure to adhere the second plate to the first plate.

According to another aspect of the invention, an ink channel for an inkjet print head includes first and second plates, an adhesive sheet including an adhesive element and a polymer matrix, the adhesive element having a melting and curing temperature lower than that of the polymer matrix.

According to another aspect of the invention, a method of forming an ink channel unit includes adhering together first and second plates with an adhesive sheet having an adhesive element and a polymer matrix. The adhesive element having a melting and curing temperature lower than that of the polymer matrix.

Further, according to another aspect of the invention, a method of forming an ink channel unit includes measuring a high temperature strength of a polymer matrix in an adhesive sheet. Then, based on the measuring, reproducibly controlling a thickness of the adhesive sheet is gained for forming the adhesive sheet on one of first and second plates to adhere the first and second plates together.

In an exemplary embodiment of the present invention, a matrix is formed from a straight-chain macromolecule that can be formed as a sheet. An adhesive element having a low molecular weight is dispersed in this matrix. An adhesive agent sheet can adhere an adhesion module (e.g., plate) with an adhesive element that seeps out while maintaining a particular thickness for the adhesive layer even in heating and pressurizing processes. As a result, spreading of the adhesive agent into ink channels can be reproducibly controlled.

With the unique and unobvious aspects and exemplary embodiments of the invention, the specific mechanism by which adhesion takes place is controlled. In this manner, the present invention is able to provide advantages including an optimal spreading out of an adhesive agent into ink channels and an adhesive method having good reproducibility. Thus, an inkjet head with uniform ink jetting characteristics may be provided.

The present disclosure relates to subject matter contained in Japanese Patent Application No. 2001-321582, filed on Oct. 19, 2001, and Japanese Patent Application No. 2002-244722, filed on Aug. 26, 2002 which are expressly incorporated herein by reference in their entirety.

BRIEF DESCRIPTION OF THE DRAWINGS

The foregoing and other purposes, aspects and advantages will be better understood from the following detailed description of preferred embodiments of the invention with reference to the drawings, in which.

DETAILED DESCRIPTION OF PREFERRED EMBODIMENTS OF THE INVENTION

Figure 1:
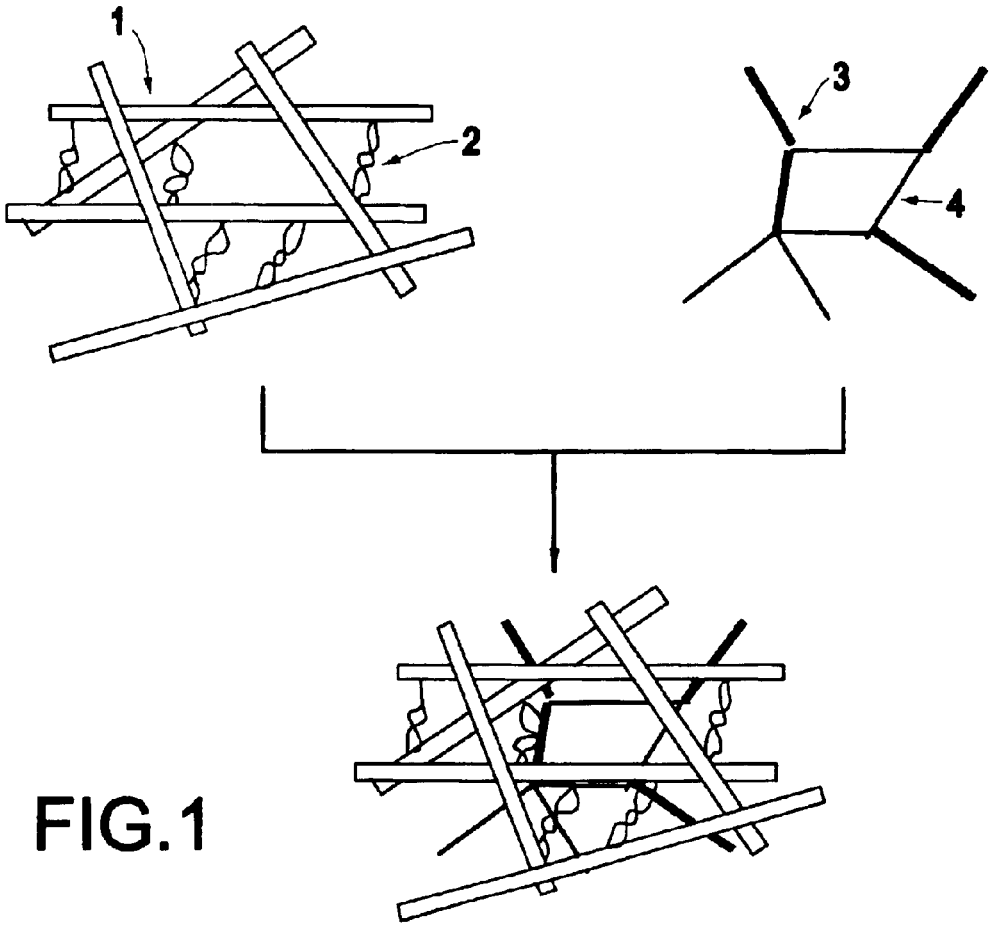
FIG. 1 is a simplified drawing showing an embodiment of the structure of an adhesive sheet according to the present invention.

Referring now to the drawings, and more particularly to FIGS. 1–7, there are shown preferred embodiments of the method and structures according to the present invention.

Figure 5:
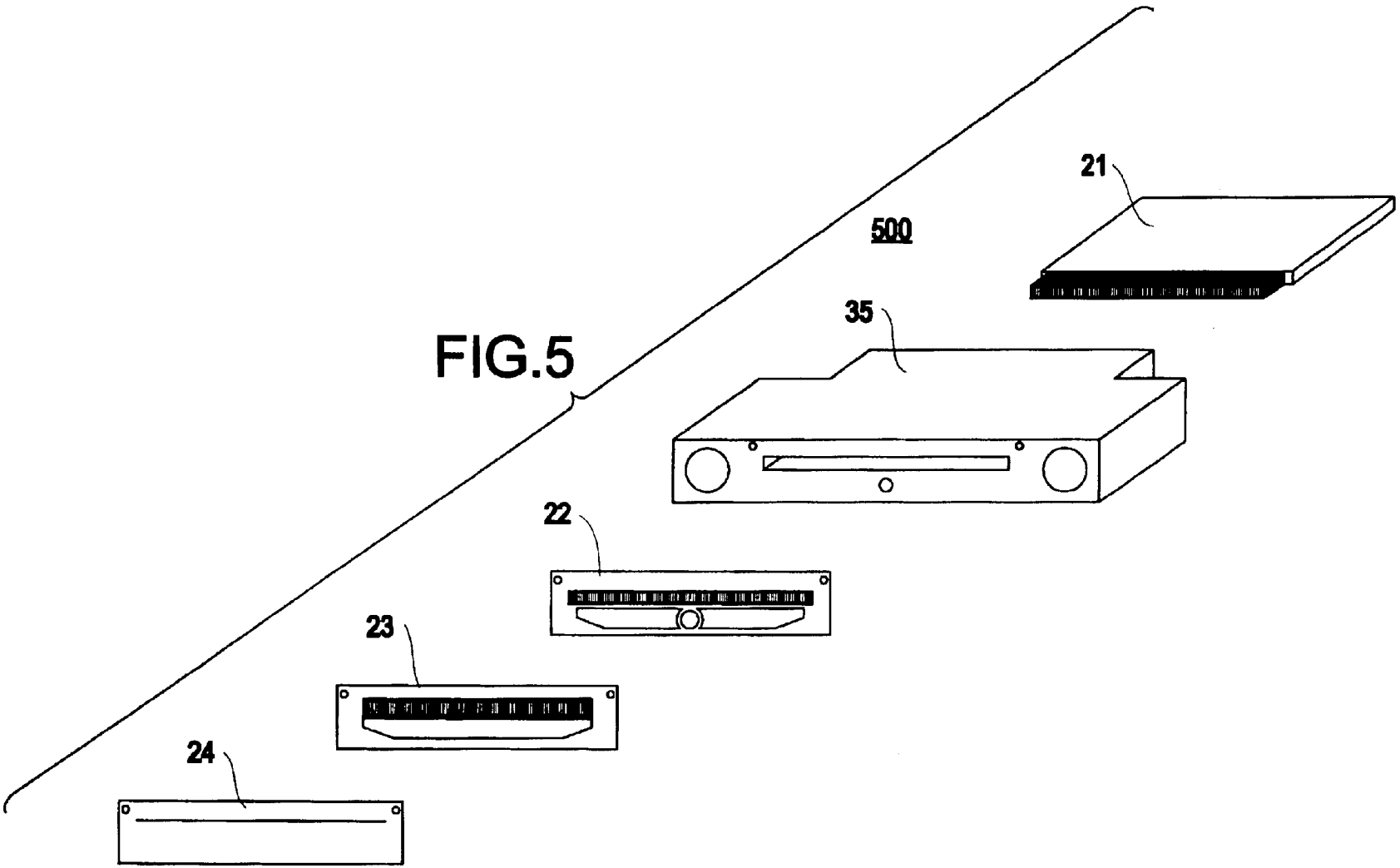
FIG. 5 is an exploded perspective view showing an embodiment of an inkjet print head according to the present invention.

Referring to FIG. 5, the overall architecture 500 of an inkjet print head of an embodiment of the present invention will be described.

FIG. 5 is an exploded perspective view of an exemplary inkjet print head according to the present invention. The inkjet print head includes a piezoelectric element substrate 21 on which is attached a piezoelectric element (not referenced in FIG. 5) serving as a pressure generating element, a diaphragm substrate 22 transferring pressure generated by the pressure generating element, a chamber substrate 23 equipped with a pressure chamber in which ink is pressurized and a chamber connected to nozzles (not referenced in FIG. 5), and a nozzle substrate 24 including a plurality of nozzles (not referenced in FIG. 5). These elements are adhered and attached to a head holder 35.

The pitch at which the nozzles are arranged is 1/100 inch (e.g., approximately 254 microns) and 96 nozzles are arranged in a row. However, the present invention does not restrict the combination of the number of nozzles, the number of rows, or a unit structure that can be used.

Figure 6:
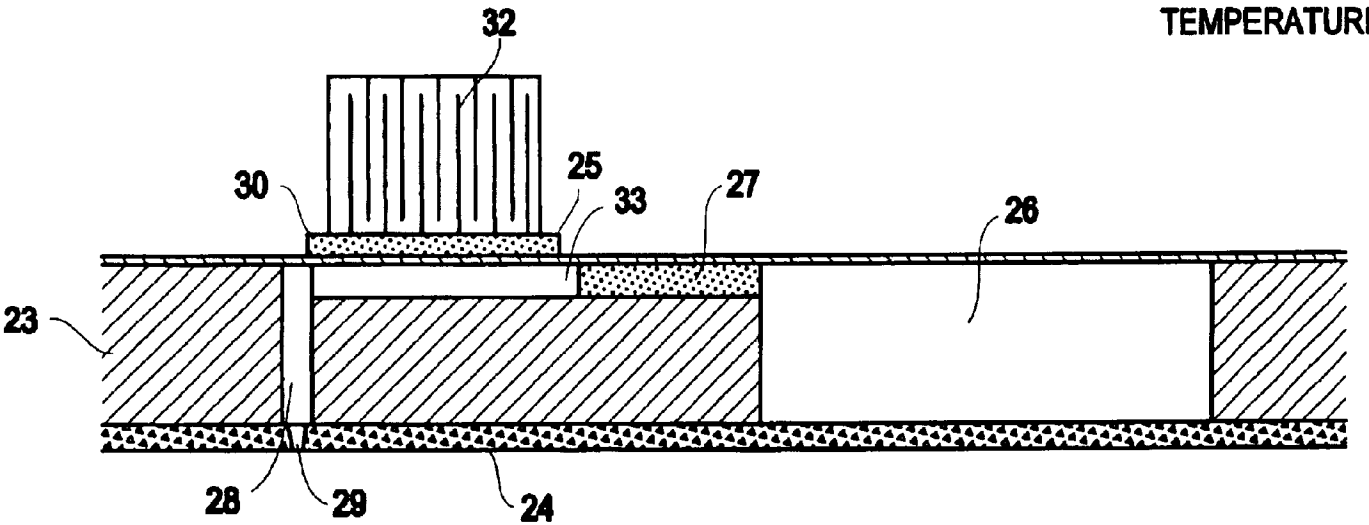
FIG. 6 is a cross-sectional view showing an inkjet print head of an embodiment according to the present invention.

FIG. 6 shows a cross-section of the inkjet print head cut along a plane parallel to the direction of ink flow in the pressure chamber 25, where pressure is generated by the deformation of a section of the wall. As shown in FIG. 6, the inkjet print head has a nozzle 29 disposed in a nozzle substrate 24, a chamber 28 serving as an independent ink reservoir, a diaphragm 33, and a foot (e.g., substrate) 30 disposed to efficiently transfer displacement of the piezoelectric element 32 to the diaphragm 33.

The piezoelectric element 32, which is a pressure-generating element, is mechanically secured to a substrate (not shown in FIG. 6) having an adequate rigidity. The mechanical energy generated by the piezoelectric element 32 (e.g., in this example, a laminated structure) is transferred to the ink in the pressure chamber 25 via the diaphragm 33.

The principles involved in ink jetting will be described briefly with reference to the drawings.

When in a standby state, there is no flexure in the diaphragm 33, but when a voltage is applied, the piezoelectric effect causes the piezoelectric element 32 to contract in the upward direction of FIG. 6. Then, when the voltage is turned off, there is a displacement in the piezoelectric element 32 as it returns to its original position. As a result, ink is ejected from the nozzle 29 by the pressure generated by the diaphragm 33. The generated pressure is applied uniformly, and a restrictor 27 attached to the pressure chamber 25 assists in the efficient transfer of the pressure to the nozzle 29.

In the inkjet print head described above, the present invention uses an adhesive sheet for the adhesion between the diaphragm substrate 33, the adhesion between the chamber substrate 23 and the nozzle substrate 24, and/or the production of the chamber substrate 23 itself.

This adhesive sheet is formed by dispersing an adhesive resin onto a non-adhesive resin sheet (e.g., polymer matrix) and attaching this to a carrier sheet. With this adhesive sheet, adhesion is provided by the seepage of adhesive elements from the polymer matrix when heat or pressure is applied.

The thickness of the adhesive layer can be controlled through the thickness of the polymer matrix. A simplified analogy of this process is a sponge containing water. The water is the adhesive element and the sponge is the polymer matrix. Water in the sponge seeps out if the sponge has pressure applied thereto (e.g., squeezed). By controlling the pressure on the sponge, the thickness of the adhesive layer can be controlled. Thus, by taking advantage of this characteristic, adhesion can be provided while controlling the spreading out of the adhesive.

Figure 7:
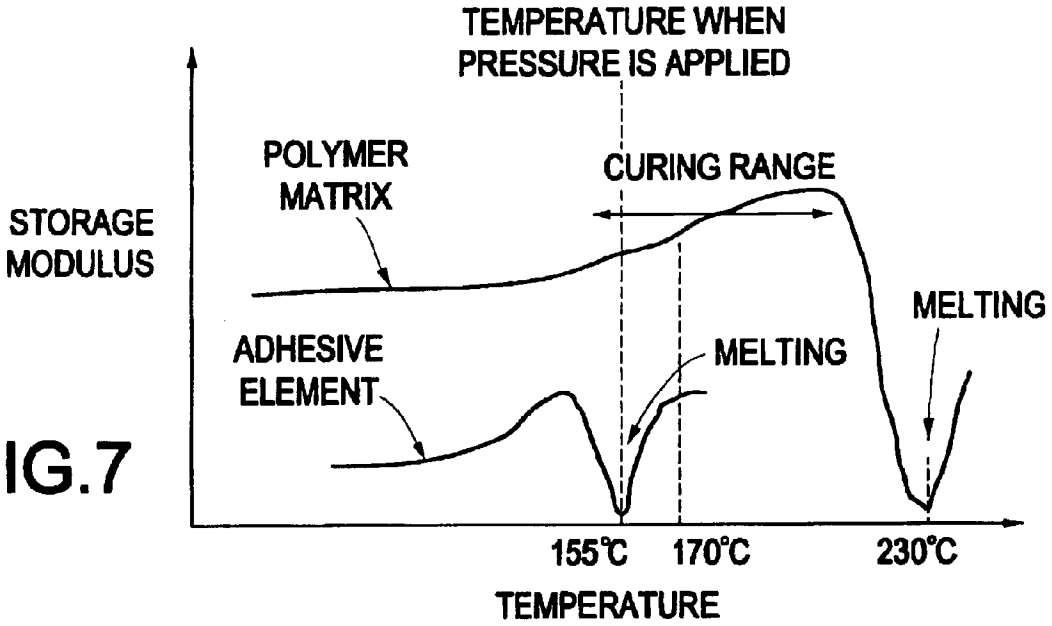
FIG. 7 is a graph showing the relationship in an embodiment of the invention between a temperature and storage modulus in a polymer matrix and an adhesive element according to the present invention.

Referring to FIG. 7, which shows the relationship between storage modulus and temperature, the relation between the adhesive element and the polymer matrix used in the adhesive sheet is highlighted.

Specifically, as the temperature rises, the storage modulus of the polymer matrix used in the present invention increases and the polymer matrix begins to cure at about 170 degrees C. Then, the elasticity ratio decreases at approximately about 230 degrees C. due to fusion.

The storage modulus of the adhesive element is much lower than that of the polymer matrix, and in the embodiment of the present invention, melt and resolidification takes place at about 150 degrees C. to about 160 degrees C.

Thus, for example, pressure can be applied at about 170 degrees C. so that, in the adhesive sheet, the molten adhesive element that seeps out at the adhesion boundary surface of the polymer matrix can cure while the shape and a fixed thickness of the polymer matrix can be maintained.

The description above is an overview of adhesion in terms of the relationship between temperature and storage modulus. However, the main characteristic of this adhesive sheet is that the fusing and curing temperature of the adhesive element is lower than that of the polymer matrix.

With such a characteristic, the specific mechanism by which adhesion occurs in an embodiment of the invention can provide numerous advantages.

In an exemplary embodiment of the invention, an adhesive sheet, for example, in the form of a greensheet, is heated. The adhesive element, which has a lower melting point, melts first. The adhesive element seeps onto the surface to be adhered, and is cured as a result of a reaction with a curing agent added to the adhesive sheet.

During this time, the resin in the polymer matrix, which has a higher melting point, maintains its shape while in an elastomeric state. Then, as heating is continued with a higher temperature, the polymer matrix is cured due to the cross-linking agent.

Thus, if the high-temperature strength of the polymer matrix is measured in advance, thickness can be controlled in a reproducible manner. This is a major difference between the adhesive sheet that uses a polymer matrix according to the present invention and the conventional adhesive agent (or coating film) formed from an epoxy adhesive agent with a low molecular weight over the entire adhesive surface.

Preferred embodiments of the adhesive sheet and a method of adhesion used in the present invention will be described below, with reference to the drawings.

Embodiment 1

FIG. 1 is a simplified drawing of an adhesive agent used in an embodiment of the present invention. The adhesive agent, shown prior to curing, is formed as a structure (e.g., varnish 6) in which two types of resin are mixed. More specifically, a structure is formed including a straight-chain macromolecule 1 having an average molecular weight of about 50000 amu together with a cross-linking agent 2, and an adhesive component 3 together with a curing agent 4 thereof.

First, when the epoxy resin is prepared with a different molecular weight and applied as a varnish 6, an epoxy resin with an average molecular weight of about 50000 amu or greater forms a film with high strength and elongation characteristics, and good flexibility.

If the average molecular weight is increased to about 50000 amu, then the cross-linking agent 2 is added due to the thermoplasticity of the epoxy resin. Also, the adhesive element is fused and cured at temperatures lower than those for the polymer matrix, so a molecular weight of about 10000 amu or less (e.g., and more preferably about 1500 or less) is desirable.

Figure 2:
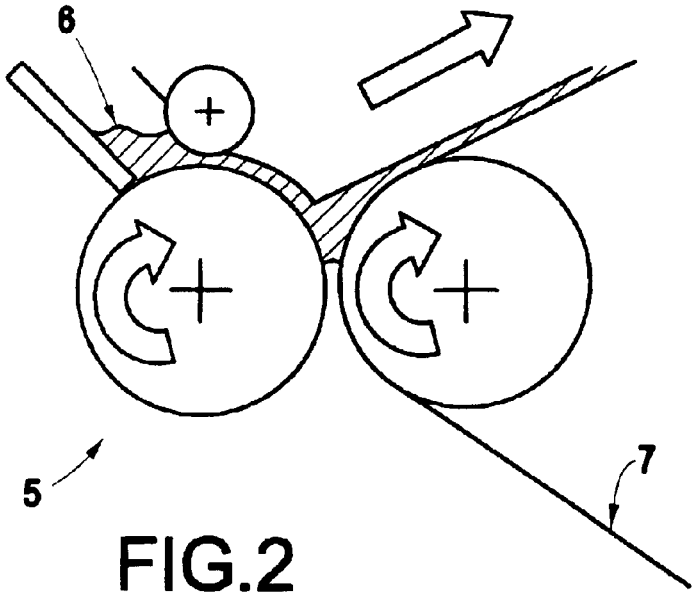
FIG. 2 is a simplified drawing showing an embodiment of a method for producing adhesive sheets according to the present invention.

As shown in FIG. 2, the varnish 6 is applied with a thickness in a range of about 1 micron to about 20 microns onto a carrier sheet 7 on which a release agent layer 8 is formed in advance using a top feed reverse roll coater 5. The varnish 6 is dried at a temperature of about 90 degrees C. to about 150 degrees C. At this state, the epoxy resin having an average molecular weight of about 50000 amu or more is made into a film (not shown) to form the polymer matrix.

Figure 3:
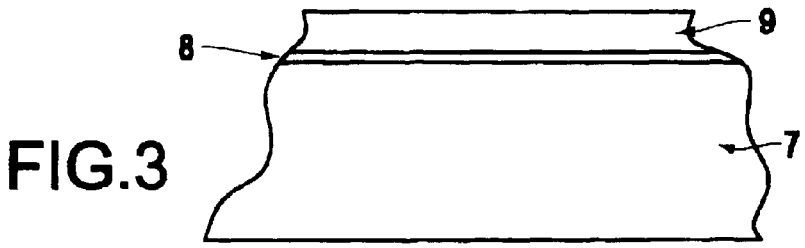
FIG. 3 is a cross-sectional view showing details of an adhesive sheet in an embodiment according to the present invention.
Figure 4A:
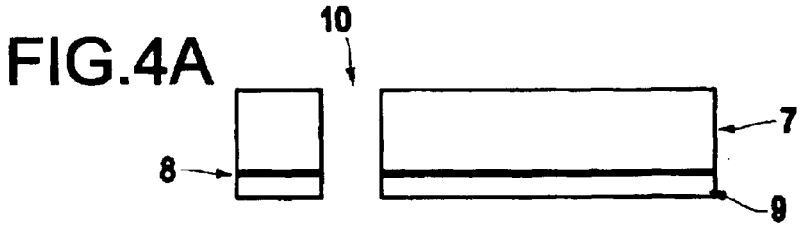
FIGS. 4(*a*)–4(*d*) are process diagrams showing an embodiment of a method for making adhesive sheets according to the present invention.
Figure 4B:
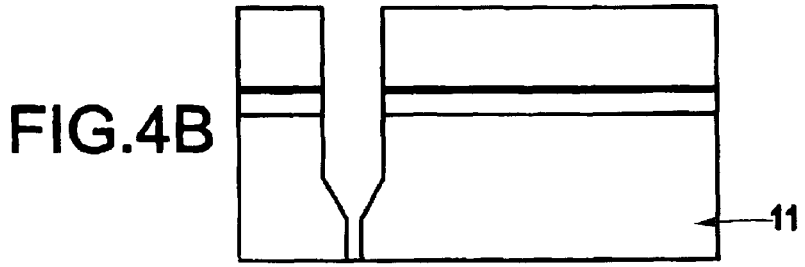
Figure 4C:
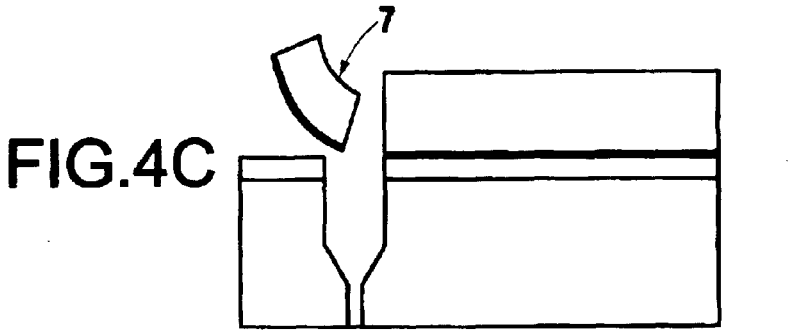
Figure 4D:
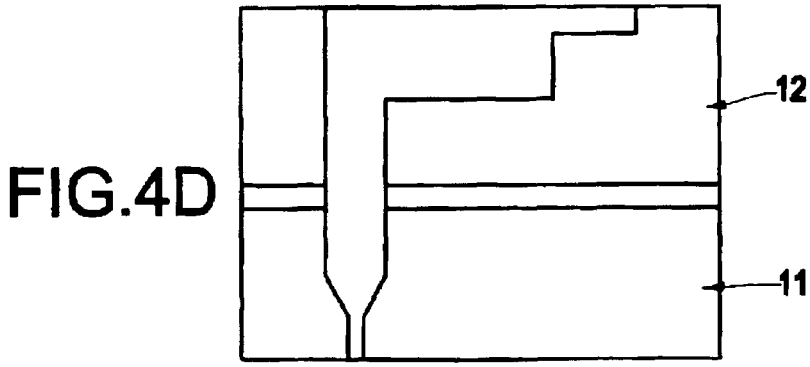

As shown in FIG. 3, this results in an adhesive sheet 9 having dispersed therein an epoxy resin with low molecular weight serving as the adhesive element. A release agent layer 8 is interposed between the carrier sheet 7 and the adhesive sheet 9.

Next, referring to FIGS. 4(*a*)–4(*d*), an overview of a method for adhering the different elements (hereinafter referred to as an "adhesion component") during the production process of the inkjet print head will be described.

As shown in FIG. 4(*a*), in a first process a punched opening (e.g., pattern) 10 is formed by removing non-adhesion sections either through mechanical punching methods or through thermal/chemical means (e.g., with a laser). This pattern is formed based on the channel pattern of the adhesion component 11 (e.g., the shape of the pressure chamber, the restrictor, and the like).

Next, as shown in FIG. 4(*b*), in a further process an adhesion device (e.g., tool) (not shown) is used to set the adhesive sheet against the channel pattern of the adhesion component 11. Preliminary adhesion is performed at about 130 degrees C. and 5 kgf/cm$^2$.

Furthermore, in the process shown in FIG. 4(*c*), after removing the adhesion component 11 from the adhesion device, the carrier sheet 7 and the release agent layer 8 are peeled off. From this state, the adhesive element begins to seep out to the surface of the adhesion component 11, but does not begin to cure. Of course, the present invention is not restricted to the preliminary adhesion conditions described above as long as the carrier sheet can be peeled off of the adhesion component 11.

Finally, in a process as shown in FIG. 4(*d*), the adhesion device is heated to about 170 degrees C., the adhesion component 12 to be adhered to the adhesion component 11 is positioned, set in the device, and pressure is applied for 15 minutes at 5 kgf/cm$^2$ to perform the adhesion.

At the temperature, the polymer matrix is squashed, so adhesive component 3 is covered not only adhesion component 11 but also adhesion component 12. At the state, the adhesive sheet 9 is heated and/or pressured, adhesive component 3 is seeped out from the polymer matrix, as the result the adhesive force become to increase. Moreover, the polymer matrix is able to control the thickness by the pressure force.

In an example of the process described above, the solids content of the adhesive element relative to the polymer matrix is set to about 15%. Positive results are obtained with an adhesive sheet having a thickness of about 5 microns. A width of spreading out of the adhesive onto the pattern 10 was about 1 micron or less.

In this manner, an inkjet print head was produced and the supplying of ink through the channels in the head was observed. No ink eddies or bubbles resulting from adhesive projections were observed, and ink was supplied smoothly. Also, a jetting test showed an excellent jetting performance.

Embodiment 2

In this embodiment, the solids content of the adhesive element relative to the polymer matrix 100% is varied from about 1 to about 100%. In an example of this embodiment of the invention, measurements were made of the spreading out of the adhesive when a nozzle substrate 24 and a chamber substrate 23 is adhered, as shown in FIG. 6.

The results of the example showed that with a nozzle aperture diameter of about 50 microns, the spreading out was about 1 micron or less for about 0% to about 15%, about 2 microns for about 15% to about 30%, about 3 microns for about 30% to about 60%, and about 10 microns for more than about 60%.

Objectives can be met, even with a solids content of the adhesive element relative to the polymer matrix of about 60% or more, if the spreading out is taken into account ahead of time and a larger punch is made in the sheet.

In this example, a thickness of about 5 microns for the adhesive sheet when the nozzle substrate 24 and the chamber substrate 23, as shown in FIG. 5, were applied. It has been found that results similar to the example using about 5 microns can be obtained provided that the adhesive sheet has a thickness of about 1 to about 10 microns.

In an example using a varnish prepared with the maximum appropriate value of about 60%, an inkjet print head was produced and the flow of ink to the channels was observed. No ink eddies or bubbles resulting from adhesive projections were observed, and ink was supplied smoothly. Also, a jetting test showed an excellent jetting performance.

According to the present invention, spreading out of the adhesive agent into ink channels can be controlled and an adhesive method having good reproducibility can be implemented. This makes it possible to provide an inkjet head with uniform ink jetting characteristics.

While the invention has been described in terms of several preferred embodiments, those skilled in the art will recognize that the invention can be practiced with modification within the spirit and scope of the appended claims.

Further, it is noted that Applicant's intent is to encompass equivalents of all claim elements, even if amended later during prosecution.

What is claimed is:

1. An inkjet print head with an ink channel unit, said inkjet head comprising:

a plurality of plates; and an adhesive sheet for adhering together said plurality of plates, said adhesive sheet including an adhesive element dispersed in a polymer matrix, said polymer matrix including a resin.

2. The inkjet print head according to claim 1, wherein said polymer matrix further includes a cross-linking agent.

3. The inkjet print head according to claim 1, wherein said resin includes an epoxy resin with an average molecular weight of at least about 50000 amu.

4. The inkjet print head according to claim 1, wherein a curing temperature of said adhesive element is lower than a curing temperature of said polymer matrix, and wherein said adhesive element includes an epoxy resin having a low average molecular weight of no more than about 10000 amu.

5. The inkjet print head according to claim 1, wherein a ratio of said adhesive element to said polymer matrix is within a range of about 1% to about 60% by solids content weight.

6. The inkjet print head according to claim 1, wherein said adhesive sheet has a thickness of about 1 micron to about 10 microns.

7. An ink channel for an inkjet print head, said ink channel comprising:

first and second plates; and an adhesive sheet including an adhesive element and a polymer matrix, the adhesive element having a melting and curing temperature lower than that of the polymer matrix.

8. The ink channel according to claim 7, wherein said polymer matrix comprises a non-adhesive element.

9. The ink channel according to claim 8, wherein a storage modulus of the adhesive element in said adhesive sheet is less than a storage modulus of the non-adhesive element of said polymer matrix.

10. The ink channel according to claim 8, wherein said adhesive sheet comprises a straight-chain macromolecule with an average molecular weight of at least about 50000 amu, an adhesive component with an average molecular weight of no more than about 10000 amu, and a curing agent.

11. The ink channel according to claim 10, wherein said adhesive component comprises an average molecular weight of about 1500 or less.

12. The ink channel according to claim 7, wherein said polymer matrix includes a cross-linking agent.

* * * * *